US010204521B2

(12) United States Patent
Cui et al.

(10) Patent No.: US 10,204,521 B2
(45) Date of Patent: Feb. 12, 2019

(54) METHOD AND SYSTEM ON DYNAMIC CONTROL OF UAVS USING SOFTWARE DEFINED NETWORKS

(71) Applicant: AT&T INTELLECTUAL PROPERTY I, L.P., Atlanta, GA (US)

(72) Inventors: Zhi Cui, Sugar Hill, GA (US); Sangar Dowlatkhah, Alpharetta, GA (US); Venson Shaw, Kirkland, WA (US)

(73) Assignee: AT&T Intellectual Property I, L.P., Atlanta, GA (US)

( * ) Notice: Subject to any disclaimer, the term of this patent is extended or adjusted under 35 U.S.C. 154(b) by 202 days.

(21) Appl. No.: 15/252,654

(22) Filed: Aug. 31, 2016

(65) Prior Publication Data

US 2018/0061249 A1 Mar. 1, 2018

(51) Int. Cl.
*G08G 5/00* (2006.01)
*G08G 5/02* (2006.01)

(52) U.S. Cl.
CPC ..... *G08G 5/0043* (2013.01); *G08G 5/006* (2013.01); *G08G 5/0013* (2013.01); *G08G 5/0026* (2013.01); *G08G 5/0039* (2013.01); *G08G 5/0056* (2013.01); *G08G 5/0069* (2013.01); *G08G 5/0082* (2013.01); *G08G 5/0091* (2013.01); *G08G 5/025* (2013.01)

(58) Field of Classification Search
CPC .. G08G 5/0043; G08G 5/0069; G08G 5/0039; G08G 5/0004–5/0017; G08G 5/0026; G08G 5/003; H04W 84/005; H04W 84/18
See application file for complete search history.

(56) References Cited

U.S. PATENT DOCUMENTS

| | | | |
|---|---|---|---|
| 8,600,602 B1 | 12/2013 | McAndrew et al. | |
| 8,983,682 B1 | 3/2015 | Peeters et al. | |
| 9,274,529 B2 | 3/2016 | Ben-Shachar et al. | |
| 2015/0063202 A1 | 3/2015 | Mazzarella et al. | |
| 2015/0142211 A1 | 5/2015 | Shehata et al. | |
| 2015/0288622 A1 | 10/2015 | Fargano et al. | |
| 2015/0338855 A1* | 11/2015 | Stark | B64C 39/024 701/3 |

(Continued)

FOREIGN PATENT DOCUMENTS

| | | |
|---|---|---|
| WO | WO 2014/160997 A1 | 10/2014 |
| WO | WO 2016/049609 A1 | 3/2016 |
| WO | WO 2016/057098 A2 | 4/2016 |

OTHER PUBLICATIONS

DeGarmo et al.; "Prospective Unmanned Aerial Vehicle Operations in the Future National Airspace System"; AIAA 41th Aviation Technology, Integration and Operations (AITO) Forum; 2004; 8 pages.

(Continued)

*Primary Examiner* — Spencer D Patton
(74) *Attorney, Agent, or Firm* — Baker & Hostetler LLP

(57) ABSTRACT

A system for in-flight communications with an unmanned aerial vehicle (UAV) includes a software defined command and control center, a cell broadcast center in communication with the command and control center and also in communication with the UAV, wherein the UAV is associated with a software defined user equipment (UE) category and a message generated by the cell broadcast center identifies the UAV based on the UE category.

20 Claims, 7 Drawing Sheets

(56) References Cited

U.S. PATENT DOCUMENTS

2016/0328979 A1* 11/2016 Postrel ..... B64C 39/024
2017/0287341 A1* 10/2017 Jarrell ..... G08G 5/0069

OTHER PUBLICATIONS

Santamaria et al.; "Increasing UAV Capabilities Through Autopilot and Flight Plan Abstraction"; IEEE Digital Avionics Systems Conference; 2007; 10 pages.

* cited by examiner

METHOD AND SYSTEM ON DYNAMIC CONTROL OF UAVS USING SOFTWARE DEFINED NETWORKS

TECHNICAL FIELD

Embodiments of the present inventions relate to methods and systems for controlling unmanned vehicles (UVs), and more particularly to methods and systems that uses software defined machine concepts to provide maps and in-flight communications for an Unmanned Arial Vehicle ("UAV").

BACKGROUND

Today a large number of companies are greatly expanding their use of UAVs. UAVs have been used for military applications, search-and-rescue missions, scientific research, delivering goods, and other uses. UAVs can include a plurality of airborne platforms or air vehicles, each carrying a plurality of sensors that may be used to collect information about an area under surveillance or to deliver a payload to a certain location. The airborne platforms may communicate with users, which may include persons or equipment, that desire access to data collected by the sensors or desire to control the UAV. More sophisticated UAVs have built-in control and/or guidance systems to perform low-level human pilot duties, such as speed and flight path surveillance, and simple pre-scripted navigation functions.

Initial deployment of UAVs uses normal static or semi-static databases for pre-configured routes and for the communication with different groups of UAVs. This serves well for the basic UAV operations, but due to the dynamic changing of the environment and service provider policies, etc. static behaviors of the UAVs are very limiting. More dynamic capabilities and enhancements are needed to bring greater value to the use of UAVs.

In addition, UAVs flying in the sky may also pose potential risks, for instance, at public gatherings or during local or national emergency situations. There are a number of methods to communication with UAVs and giving instructions e.g. using point to point communication between Command and Control Center (CCC) and each UAV, Satellite, and even Wi-Fi for short range UAVs. However, these existing approaches are inefficient and often times cost-prohibitive. Thus there is a need for more efficient way of communicating with a group of UAVs in a geographic area or region.

SUMMARY

In an embodiment, the disclosure includes a system for in-flight communications with an unmanned aerial vehicle (UAV) including a software defined command and control center in communication with the UAV and wherein the UAV is associated with a software defined user equipment (UE) category and a message created by the command and control center identifies the UAV based on the UE category. The system may include wherein the command and control center is configured to receive an input from an external source and to generate the message as a function of the input and 2 wherein the input is one of an event, emergency or weather.

In an aspect, the message may include an identification of the input and the UAV is configured to change its flight plan based on the message. The system may further include a policy generator and wherein the command and control center is configured to receive policy updates from the policy generator and to create the message as a function of the policy received from the policy generator. In an aspect, the command and control center is configured to receive policies and to change its configuration dynamically based on one of a policy generator, the type of UAV, weather or an external event.

In an aspect, the system may further include a plurality of UAVs, each of the plurality of UAVs associated with a UE category, a cell broadcast center in communication with the command and control center and also in communication with the UAV and wherein the cell broadcast center is configured to relay the message only to the UAVs having the UE category identified in the message. The UE category is one of government, transport and surveillance.

The disclosure also includes a system including an unmanned airborne vehicle (UAV) associated with a software defined user equipment (UE) category, a software defined command and control center in communication with the UAV, the command and control center having a processor; and a memory coupled with the processor, the memory having stored thereon executable instructions that when executed by the processor cause the processor to effectuate operations including receiving an input from an external source, creating an in-flight message to the UAV based on the input, wherein the message includes the UE category, and transmitting the message to the UAV. The message may cause the UAV to alter its flight plan based on the message.

In an aspect, the system may further include a plurality of UAVs, each of the UAVs having a UE category associated therewith and a cell broadcast center in communication with the command and control center and wherein the message is transmitted from the command and control center to the UAVs through the cell broadcast center. The system may also include only the UAVs having a UE category that matches the UE category in the message is configured to interpret the message. In an aspect, each of the plurality of the UAVs are configured to relay the message to other UAVs having the same UE category over a mesh network. In an aspect, the message may include an indication of one of an event, emergency and weather and wherein each of the plurality of UAVs reacts to the message based on the UE category of each of the plurality of the UAVs.

The disclosure also includes a method including receiving at a software defined command and control center, an input from an external source, creating, by the command and control center, an in-flight message to the UAV based on the input, wherein the message includes the UE category, and transmitting, by the command and control center, the message to the UAV. The transmitting step may cause the UAV to act based on the UE category and may further include a cell broadcast to a plurality of UAVs, each of the plurality of UAVs having a UE associated therewith, and wherein the cell broadcast causes the each of the plurality of UAVs to act based on the UE category associated with the each of the plurality of UAVs. In an aspect, the message is further relayed from one of the plurality of UAVs to another UAV a similar UE category.

BRIEF DESCRIPTION OF THE DRAWINGS

The following detailed description of preferred embodiments is better understood when read in conjunction with the appended drawings. For the purposes of illustration, there is shown in the drawings exemplary embodiments; however, the subject matter is not limited to the specific elements and instrumentalities disclosed. In the drawings.

DETAILED DESCRIPTION OF ILLUSTRATIVE EMBODIMENTS

Figure 1:
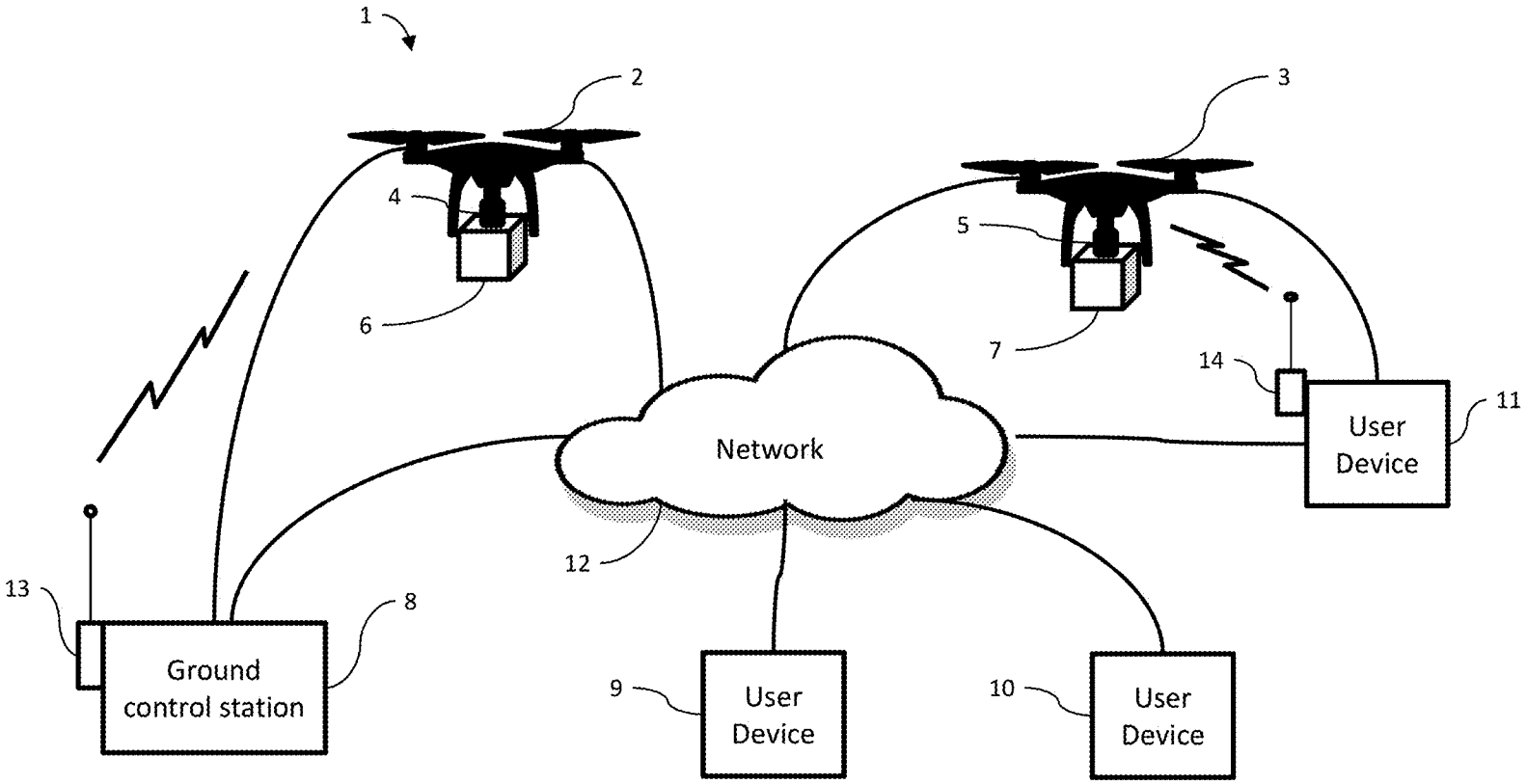
FIG. 1 is a schematic representation of an exemplary system environment in which the methods and systems to dynamically manage flight paths of UAVs near areas of concern may be implemented.

System Environment. Illustrated in FIG. 1 is a schematic representation of a exemplary system environment 1 in which embodiments of the present disclosure may operate. The system environment 1 includes UAV 2 and UAV 3, each carrying sensors (sensor 4 and sensor 5) for collecting information or payloads (payload 6 and payload 7) for delivery. Although only two UAVs are illustrated in FIG. 1, it is contemplated that the system environment 1 would encompass a plurality of UAVs. UAV 2 and UAV 3 may communicate with a command and control center 8 and a plurality of user devices (user device 9, user device 10, and user device 11). Command and control center 8 may communicate with UAV 2 through a network 12 or an RF transmitter 13. Similarly user device 11 may communicate with UAV 3 through the network 12 or an RF transmitter 14. In addition, command and control center 8 may form part of network 12, in which case command and control center 8 may be part of a software defined network 12. Network 12 may be a distributed network such as the Internet or a wireless cellular network, which may, for example, be a 3G, 4G LTE network, or any number of wireless networks that are capable of providing a communication interface to the plurality of UAVs, including advanced networks using software defined networks concepts. User device 9, user device 10 and user device 11 may comprise any wireless device such as a cell phone, a smart phone, personal data assistants (PDA) or a personal computer such as a desktop, a laptop computer or a tablet computer. Command and control center 8 may be part of a larger command and control center (not shown) which controls not only UAV flights, but which may also include other military, commercial or private flights. The command and control center 8 is typically a facility that operates as the operating entity's dispatch center, surveillance monitoring center, coordination office and alarm monitoring center all in one. Command and control center 8 may be operated by the operating entity.

Figure 2:
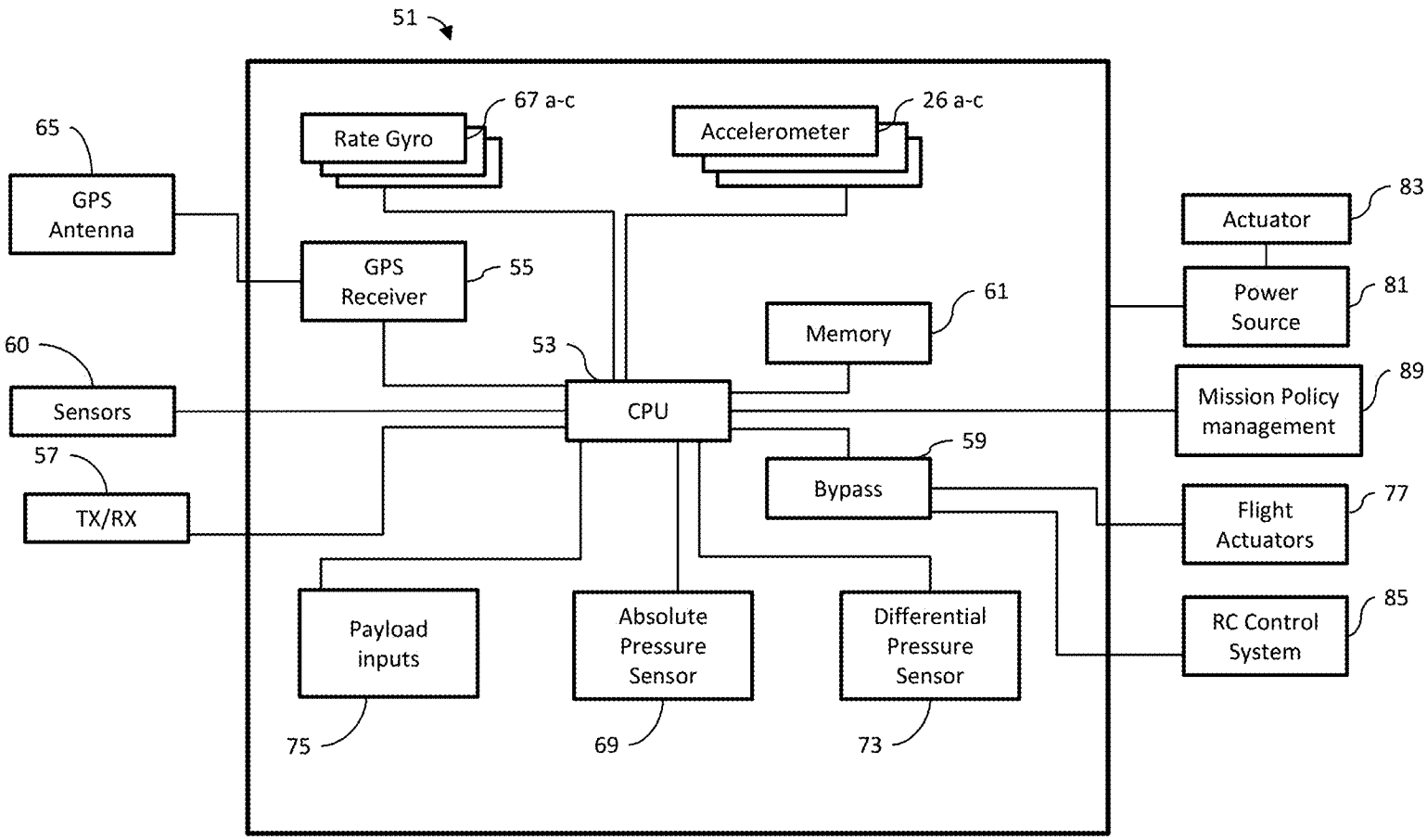
FIG. 2 is a system diagram of an exemplary UAV control system.

UAV Control System. FIG. 2 is an exemplary block diagram illustrating the main hardware and system components of one embodiment of a UAV control system 51. The UAV control system 51 includes a central processing unit (CPU 53), which is responsible for processing data and executing commands and instructions. The CPU 53 may be responsible for processing sensor data, handling I/O to a GPS receiver 55, a UAV transmitter/receiver 57, and bypass circuit 59, thereby enabling communications with the ground station. The UAV control system 51 is provided with sufficient memory to store the autopilot source code and effect runtime execution. The CPU 53 is in electronic communication with various sensors and may, for example, be responsible for processing raw data from the various sensors such as sensor 60 and storing and transmitting the data. Data is stored in memory 61, which is in electronic communication with the CPU 53. The memory 61 may include random access memory (RAM), flash memory or any other type of memory technology currently available. To control a UAV such as UAV 2 in FIG. 1, the UAV control system 51 may have access to the location coordinates of UAV 2. These coordinates are measured using the GPS receiver 55 that is in electronic communication with the CPU 53. The GPS receiver 55 receives its data through a GPS antenna 65. The fixed rotational rates of UAV 2 may be measured by rate gyros 67 *a*, 67 *b*, and 67 *c* which are in electronic communication with the CPU 53. The rate gyros 67 *a*, 67 *b* and 67 *c* are disposed to enable sensing of the rotational rates about the body axes of the UAV 2. The altitude of the UAV may be measured using an absolute pressure sensor 69 or other altitude measuring device that is in electronic communication with the CPU 53. Acceleration in the x, y, and z axes may be measured by accelerometers 26 *a*, 26 *b*, and 26 *c* which are in electronic communication with the CPU 53. The velocity of UAV 2 may be measured using a differential pressure sensor 73 in electronic communication with the CPU 53. The differential pressure sensor 73 outputs a voltage based on the difference in pressure between its two external ports. A pitot tube may be connected to one of the ports and the other is left open to the ambient air. The flow of air against the pitot tube causes a pressure difference proportional to the speed of the air. The corresponding voltage produced by the differential pressure sensor 73 may be used to calculate the airspeed of the UAV 2. The CPU 53 may be also in electronic communication with payload inputs 75 which may include data from a video processing unit or any other data that involves a payload (such as payload 6) on the UAV. The UAV is controlled using flight actuators 77 which include servos in electronic communication with the CPU 53 that control the flight of the UAV 2. The bypass circuit 59 may be provided to allow a user to take control of the UAV 2. The UAV control system 51 is electrically connected to a power source 81. In one embodiment the power source 81 may include a plurality of batteries. The power source 81 may be used to power the UAV control system 51 and connected accessories. The power source 81 may also be used to power an actuator 83 that propels the UAV 2. The UAV control system 51 may be provided with an RC control system 85 that allows a user to take control of a UAV (such as UAV 3) using an RF transmitter such as RF transmitter 14 or RF transmitter 13 shown in FIG. 1.

The UAV control system 51 may interact with a mission policy management system 89, which are described in more detail below, and that control access to the UAV control system 51 by user devices such as user device 11 (shown in FIG. 1). The access management system 87 and the mission policy management system 89 may be implemented in the UAV 2 or in the network 12.

Figure 3:
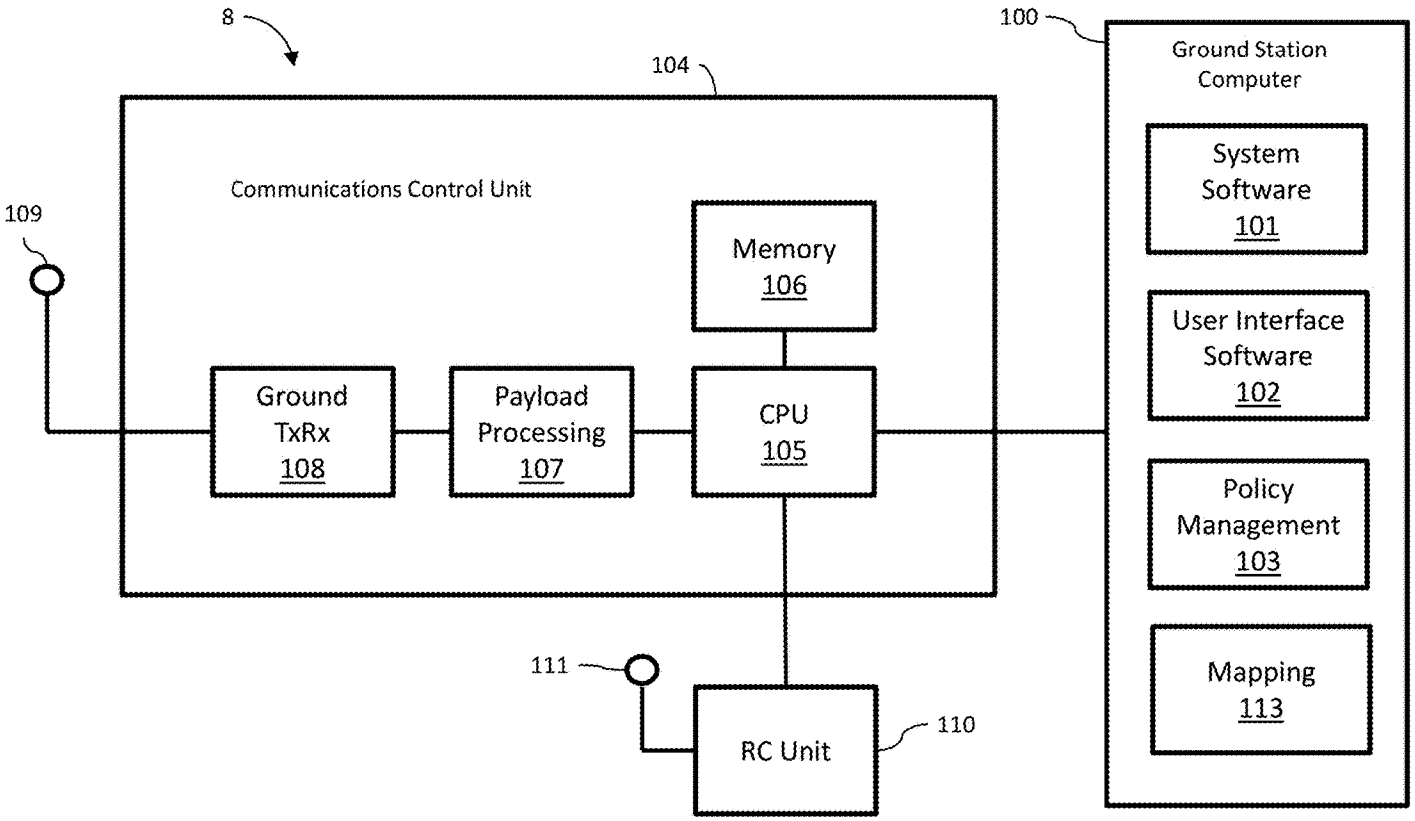
FIG. 3 is a system diagram of an exemplary embodiment of a UAV command and control center.

Command and Control Station. FIG. 3 is a block diagram illustrating an exemplary functional diagram of a command and control center 8. The command and control center 8 may include an interface to a ground station computer 100. The ground station computer 100 may be a laptop computer, a desktop computer, a personal digital assistant, a tablet PC, a wireless device such as a smart phone or similar devices. It may be a server in a network 12. The ground station computer 100 may run ground station system software 101 as well as user interface software 102. The ground station computer 100 may also run policy management software 103 that provides mission management parameters to the UAV during operations. The ground station computer 100 is in electronic communication with a ground unit 104. Electronic communication between the ground station computer 100 and the ground unit 104 may be accomplished via a serial or USB port. Ground unit 104 may include CPU 105, memory 106, a payload processing system 107, a ground transmitter/receiver 108, and a ground antenna 109. CPU 105 processes data from the ground station computer 100 and the UAV such as UAV 2 in FIG. 1. The payload processing system 107 processes any payload data received from the UAV control system 51, (shown in FIG. 2), or payload commands from the ground station computer 100. The payload processing system 107 may also be connected directly to CPU 105 or the ground station computer 100. Data from the payload processing system 107, CPU 105, or the ground station computer 100 is sent through the ground transmitter/receiver 108. The ground transmitter/receiver 108 also receives data from the UAV control system 51 (shown in FIG. 2). In an embodiment an RC controller 110 in electronic communication with the command and control center 8 (shown in FIG. 1) may be provided. The CPU 105 may also be connected to an RC unit 110 with RC antenna 111 that can be used to control the UAV 3 (shown in FIG. 1) using RC signals.

The ground station computer 100 may also include a mapping function 113. The mapping function 113 may, for example, include a three-dimensional ("3D") map of a volume of space through which a UAV may fly. The mapping function 113 may also include two-dimensional ("2D") mapping function. The mapping function 113 may include the ability to partition the space volume into either 3-dimensional volume-based sectors or two-dimensional area-based sectors encompassing and defining space in two dimensions from the ground to a relatively high altitude above the ground.

Figure 4:
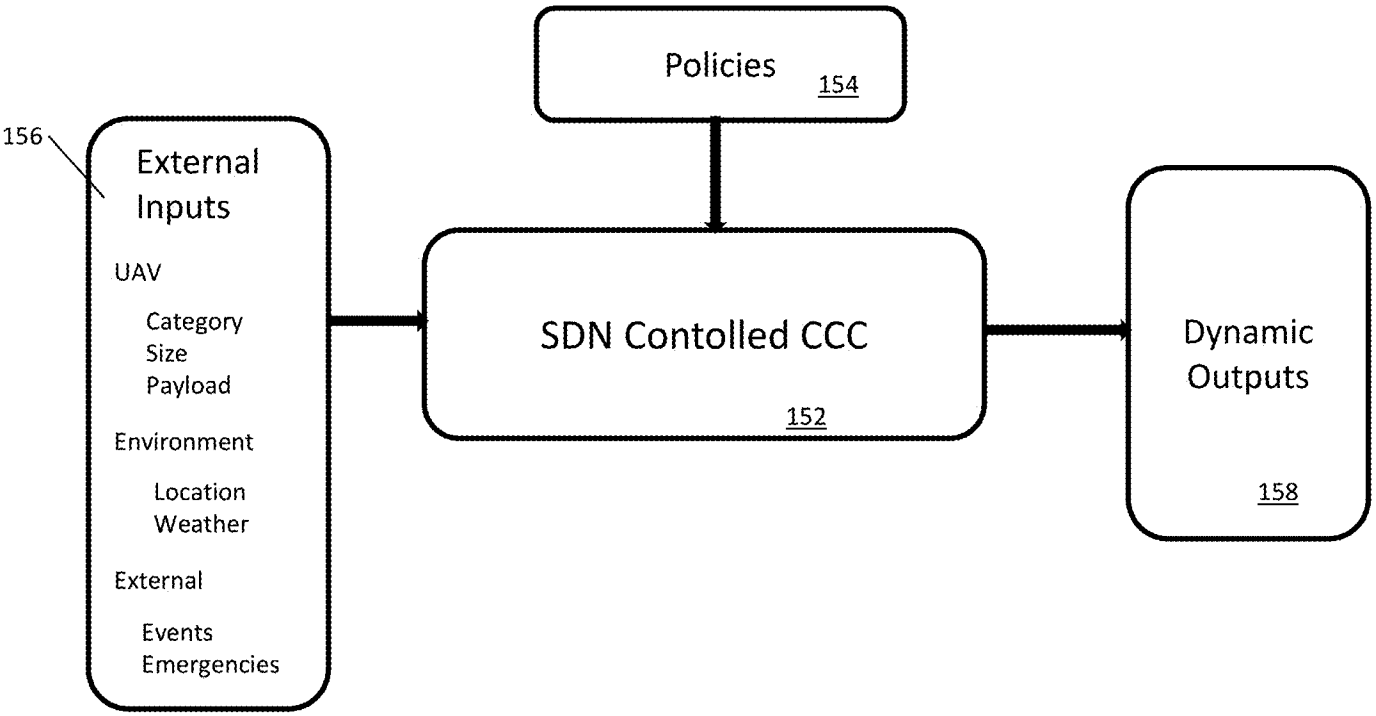
FIG. 4 is a system block diagram of an exemplary embodiment of the inputs and outputs of a software defined network command and control center.
Figure 5:
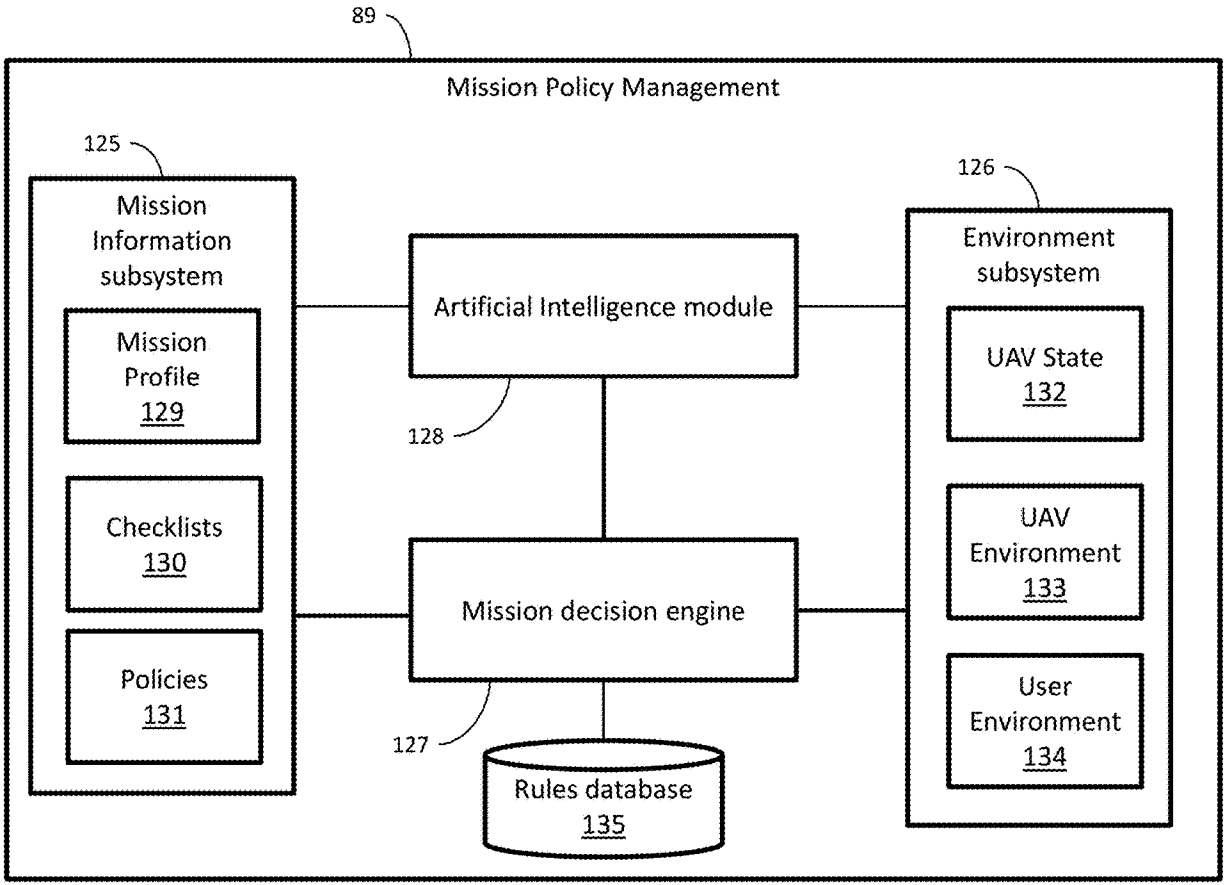
FIG. 5 is a system diagram of an exemplary embodiment of a software defined network command and control center in a cellular network environment.

With reference to FIG. 4, there is shown an exemplary command and control center 152 constructed in accordance with the present disclosure. In this embodiment, the functionality of the command and control center 152 is created using a software defined network (SDN). The policy management function 154 serves as an input to the command and control center 152 and may, for example, be similar to the policy management function 103 described above and/or the policy management function 89 described in more detail in FIG. 6 below. External inputs 156 may also serve as variable or fixed inputs to the command and control center 152. Such external inputs may, for example, include UAV specific inputs such as category, size, payload and other parameters.

In accordance with the present disclosure, software defined user equipment categories may be expanded to UAVs. For example, the following UAV categories and priorities may be established:

Government UAVs—UE category UAV-G, wherein the G represents a UAV class of Government which, in general, may receive high priority for any actions or activity.

Surveillance UAVs—UE category UAV-S, wherein the S represents a UAV class of surveillance which, in general, may receive mid-level priority for any actions or activity.

Transport UAVs—UE category UAV-T, wherein the T represents a UAV class of transport or delivery which, in general, may receive lower priority for any actions or activity.

It will be understood that other software defined UE categories may be established for other classifications or sub classification of UAVs. For example, other classifications may include examples such as A-type for Athletic applications and given a priority. S-type UAVs may include the sub classifications of live streaming of sporting events as well as mapping sectors above a natural disaster for generating no-fly or restricted flight sectors. By way of another example, G-type UAVs may include the sub classifications of military reconnaissance or weaponry as well as law enforcement surveillance. It will be understood with software defined networks and UAVs, the classifications and sub classifications may be static or dynamic.

Using these software defined UE categories, there is also included in the disclosure an efficient way of communication, e.g. a new System Information Block (SIB) message to broadcast to a group or all of UAVs to provide landing or other in-flight instructions to these UAVs, for instance, in the case of an emergency event or weather condition.

Continuing with the description of the external inputs 156, other exemplary external inputs 156 may be related to the weather or environment which may, be factors considered by the command and control center 152 in controlling the flight of UAVs. Other exemplary external inputs 156 may include events such as scheduled sporting events or political rallies or other unplanned events such as a traffic jam. Also, emergency situations may serve as external inputs and may, for example, include accidents or natural disasters.

Figure 6:
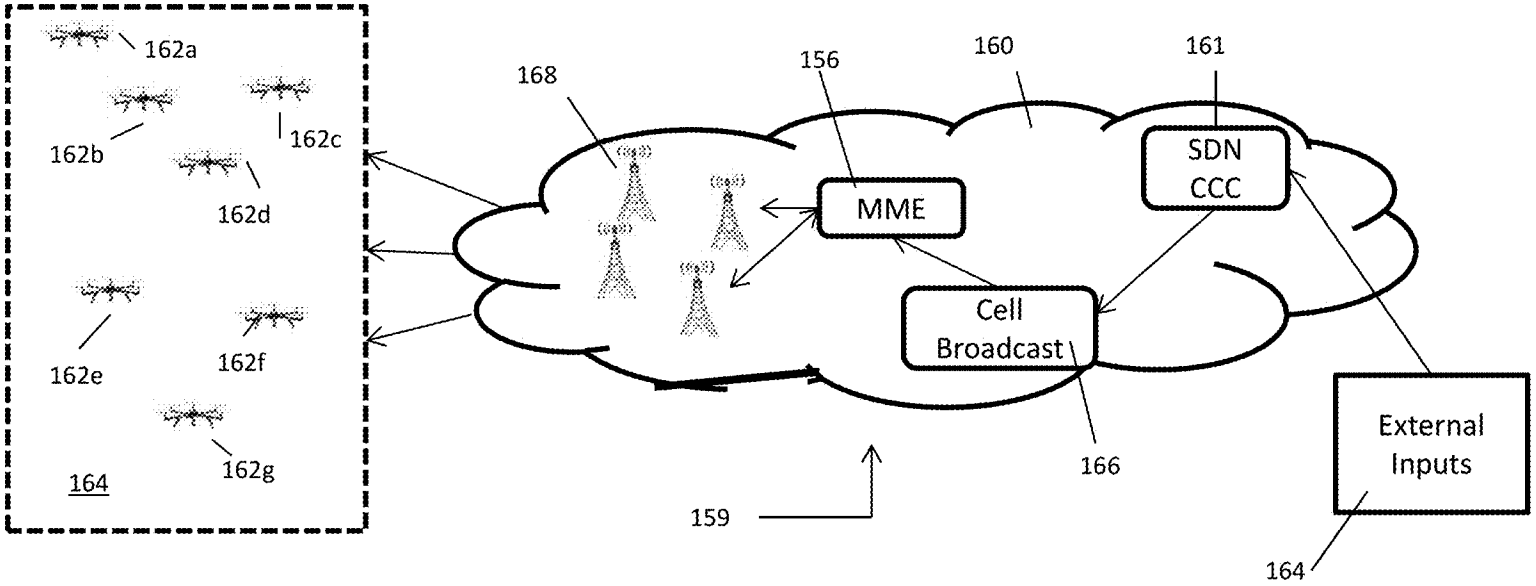
FIG. 6 is a system diagram of an exemplary embodiment of a mission policy management system

Mission Management System. Illustrated in FIG. 6 is an exemplary embodiment of the mission policy management system 89. The mission policy management system 89 may include a mission information subsystem 125 and an environment subsystem 126. The mission information subsystem 125 and the environment subsystem 126 may be coupled to a mission decision engine 127. Mission decision engine 127 may optionally be coupled to an artificial intelligence module 128 if the UAV is intended to have a self-learning capability.

The mission information subsystem 125 may include a mission profile module 129 that stores and processes mission profile information relating to the type of mission such as reconnaissance, attack, payload delivery, and the like. Associated with each mission profile will be a set of mission parameters such as regions that must be visited or avoided, time constraints, time of year, flight altitude, flight latitude, and payload mass and power, initial position of the target, direction of a target, and flight path, among others.

The mission information subsystem 125 may include a checklist module 130 that stores and processes checklists to ensure that the UAV is performing correctly during flight. Prior to and during operation, the unmanned vehicle may undergo one or more verification procedures that are performed according to one or more corresponding checklists. The checklists in the checklist module 130 generally include a sequence of various operating parameters to be verified for proper functionality and/or control actions to be taken once required operational parameters have been achieved. For example, a particular checklist implemented prior to take off may include verification of the unmanned vehicle's fuel supply and other suitable operating parameters. In addition to a checklist implemented for use with takeoff, other checklists may be implemented for other tasks performed by unmanned vehicles, such as a change in flight plan, or in response to specific events or situations that may arise during any particular mission.

The mission information subsystem 125 may also include a policies module 131. Policies module 131 may include a set of policies related to the level of control to be exercised by the command and control center 8 during flight. For example, a commercial UAV may have policies that permit flight to and from commercial distribution centers to target destinations, but restricted from airspace over military installations. A military UAV carrying weapons may have policies that permit flight in certain areas but may restrict flight over certain population centers. Other parameters for policies may include UAV and target location, customer and operator preferences, UAV status (e.g. power, type, etc.), next mission on the list, available resources and the like. The policies may, for example, contain levels of authorization which will dictate, based on defined or dynamic sectors, where a UAV may fly and where a UAV may not fly. The policies may also include authorization levels for modifying such policies during flight operations.

The environment subsystem 126 may include a UAV state module 132 which may include information about the state of the UAV such as power, payload capacity, distance to user, location and the like.

The environment subsystem 126 may also include a UAV environment module which may include information about the environment in which the UAV is operating such as weather, threat level and the like. The environment subsystem 126 may also include a user environment module which may include information about the environment in which the ground-based user is operating, such as weather, location, terrain, threat level and the like.

The mission information subsystem 125 and the environment subsystem 126 may be coupled to the mission decision engine 127 configured to receive mission parameters from the mission information subsystem 125, fetch a plurality of mission plans from the mission profile module 129, and select one of the plurality of mission profiles based upon the current requirements and the environmental parameters. The mission decision engine 127 may access a rules database (not shown) that provides rules to the mission decision engine 127. The mission decision engine 127 may also receive updated mission parameters during flight that alerts the mission information subsystem of updated sectors that may include no-fly or restricted flight zones based on the level of authorization of the UAV.

The artificial intelligence module 128 may include an inference engine, a memory (not shown) for storing data from the mission decision engine 127, heuristic rules, and a knowledge base memory (not shown) which stores network information upon which the inference engine draws. The artificial intelligence module 128 is configured to apply a layer of artificial intelligence to the mission profiles stored in the mission profile module 129 to develop relationships between mission parameters to perform and improve the assessments, diagnoses, simulations, forecasts, and predictions that form the mission profile. The artificial intelligence module 128 recognizes if a certain action (implementation of mission parameters) achieved a desired result (successfully accomplishing the mission). The artificial intelligence module 128 may store this information and attempts the successful action the next time it encounters the same situation. Likewise, the artificial intelligence module 128 may be trained to look for certain conditions or events that would necessitate the need or desire to define sectors to be used as no-fly zones or restricted fly zones. Such defined sectors may then be transmitted to the command and control system 8. The mission policy management system 89 may be incorporated in the UAV or may be a component of the network 12. It will be understood that the mission policy management system 89 described above may include all or a subset of the functions set forth above, or may include additional functions. Such a description is exemplary only and is not intended to limit the scope of the disclosure.

Application of Software Defined Networks. The proposed categories of UAVs set forth above may work with command and control centers also using software defined network principles to optimize and enhance multiple aspects of the UAV operations, including but not limited to, for example dynamic routing and different commands for different UAVs during an emergency based on the drone category and various attributes such as weather condition, size of the UAV, value of the payload, and other factors. Further, use of such a command a control center 152 will permit dynamic packet routing and communication over the virtual mesh networks between UAVs based on the drone category and various attributes, for example the level of security, type of package, and other factors, to for example, to improve security or efficiency or cost effectiveness. A software defined command and control center 152 may be reconfigured dynamically based on the external inputs or policies.

With reference to FIG. 6, there is shown a system 159 in accordance with the present invention. Components of system 159 include a wireless network 160 which may, for example, be a cellular network constructed in accordance with 4G LTE standards or any other type of wireless network, now existing or to be deployed in the future. The wireless network 160 may include standard components such as cell broadcast servers 166, Mobile Management Entity (MME) 156, and a plurality of cellular towers 168. The cell towers 168 may be in cellular communication with UAVs 162 (shown as 162*a*-162*g* in FIG. 6) within a defined space 164. In accordance with the present disclosure, a command and control center 161 may reside within the wireless network 160. The command and control center 161 may include generic or special purpose hardware which hosts software which can be configured and/or reconfigured to define the functionality of the command and control center 161.

The system 159 is able to take advantage of the capabilities of the cellular network 160 in controlling the UAV's in the areas. By using a SDN command and control center 161 may be assignable to various hardware configurations and locations with the cellular network 160. Moreover, the SDN command and control center 160 may have direct or indirect access to specific cellular capabilities, for example, the MME 156 which may for example, include functions such as managing session states, authentication, paging, mobility with 3GPP, 2G and 3G nodes, roaming, and other bearer management functions.

Use Cases. The following use cases are meant to be exemplary only and are not meant to limit the scope of the disclosure or claims in any way.

By way of example, when a storms moves into an area the SDN command and control center 161 may receive an input from the external inputs 161. Based upon the nature and expected duration of the storm, the SDN command and control center 161 may send out an alert to the UAVs 162 within space 164 regarding the storm. The UAVs may be programmed in advance as to how to respond to particular alerts or such commands may be uploaded to the UAVs 162 wirelessly. For example, in response to a storm alert, large UAVs may be programmed to fly at a higher altitude, UAV's with a high value payload may be programmed to go to the nearest shelter, while all other UAV's may be programmed to go to a home base. Othe In accordance with another exemplary use of the disclosure, if the mobile network is experiencing higher congestion, the SDN command and control center 161 may continue to communicate with the UAV in congested, UAVs with a class of UAV-G at the same frequency interval while communicating UAVs with a class of UAV-T and UAV-S at a lesser frequency interval. e Drone-T/Drone-S has less frequent communication with CCC There may be a virtual mesh network permitting communication between UAVs 162 during flight. Based on different variables such as UAV category, weather condition, level of security, organization, type of package, type of sensory, and policies, UAVs can dynamically change the communication peering, packet routing over the virtual mesh networks between UAVs to improve security.

By way of further example, government UAVs identified with the class UAV-G may dynamically detect any newly joined and recently exited UAVs and establish/update communications only with other government UAVs and UAVs with higher classes of security based on policy. By way of another example, UAVs with extremely high value payloads, there may be no communications with other UAVs permitted except law enforcement UAVs or the communications initiated by that particular UAV itself.

Figure 7:
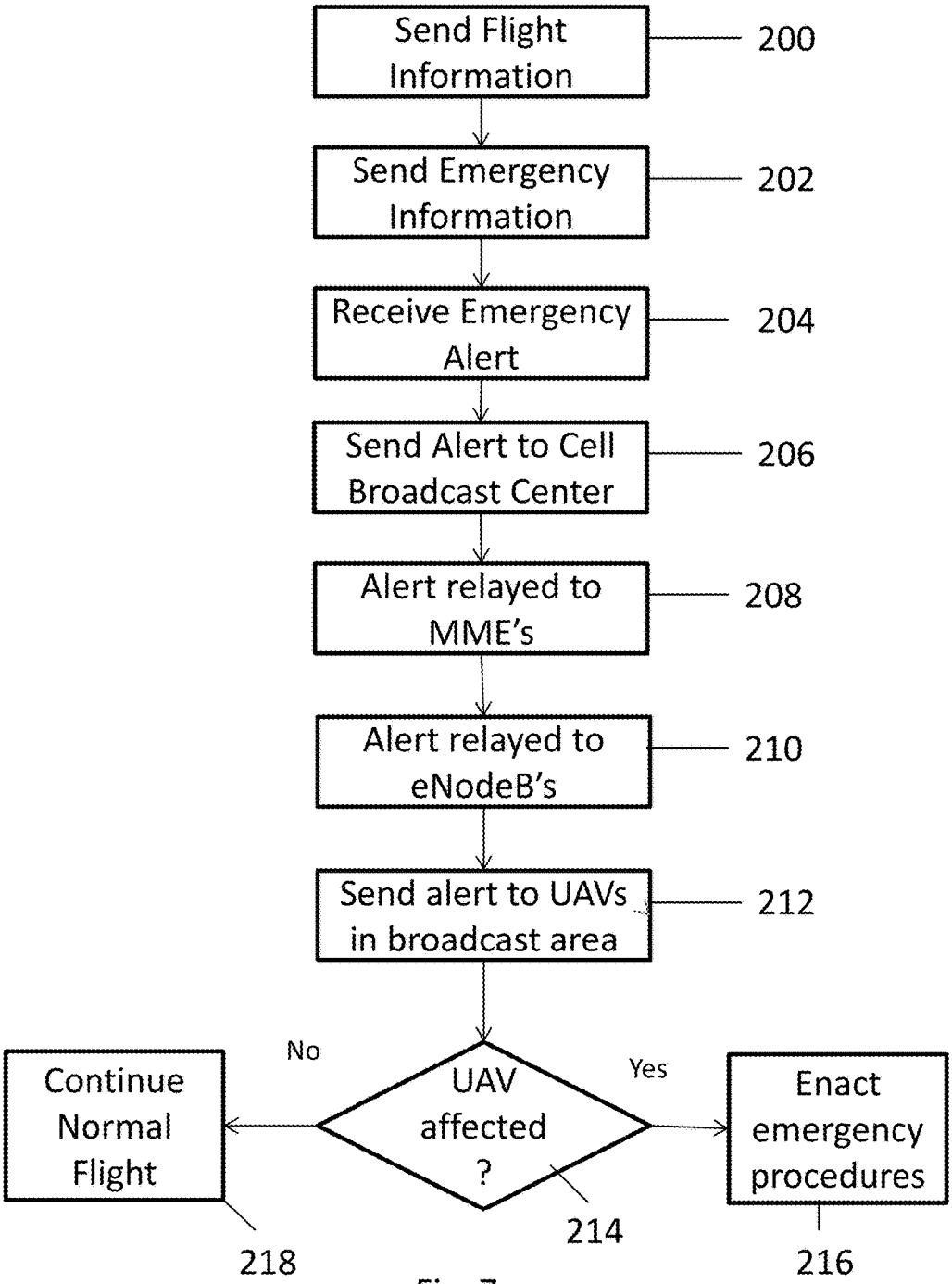
FIG. 7 is a flow diagram of an exemplary embodiment of a method for sending emergency in-flight information to UAVs.

With reference to FIG. 7, there is shown an exemplary procedure of efficient communication between the SDN command and control center 161 and various UAVs 162. In this example, the cell broadcast center 166 may be enhanced to provide APIs to allow the SDN command and control center 161 and other types of controllers to send a broadcast request to the UAVs or other devices via the mobile network.

At 200, flight information to perform a task is sent to the UAV. At 202, emergency information is sent to the UAV. The emergency information may include a list of safety landing locations and/or no fly zones in case to be used in an emergency situation, depending on the type of emergency and other factors. At 204 an emergency alert is received. This emergency alert may be received by the SDN command and control center 161 from an external input 164. When the SDN command and control center 161 is alerted with an emergency event, the SDN command and control center 161 sends emergency event message to the cell broadcast center at 206. The emergency event message may include the description of the impacted area(s), time period, and the categories of UAVs that are affected. At 208, the cell broadcast center 166 may send the broadcast message to the MME(s) 156, which in turn will relay the emergency event message to the impacted eNodeB's (eNBs) (not shown) and cell towers 168 based on the affected area at 210. At 212, the alert is sent to the UAVs 162 in the affected area 164. At 214, each UAV makes the determination whether they are affected by the emergency event message. For example, the emergency event message may specify the UAV category/categories, time period, etc. information using a newly defined system information block (SIB) message. Of the UAVs that received this SIB message, only the UAVs belonging to the specified categories will follow the instruction in the SIB message and enact the emergency procedures at 216. Other UAVs will continue their normal flight at 218.

As set forth herein, this disclosure applies SDN principles to the command and control center and UAVs to optimize and enhance multiple aspects of the UAV operations, including but not limited to, dynamic routing and different commands for different UAVs during an emergency based on the UAV category and various attributes such as weather condition, size of the UAV, value of the payload. It also provides dynamic packet routing and communication over the virtual mesh networks between UAVs based on the drone category and various attributes, such as the level of security, type of package, and other factors to improve security. The adaptability of messaging within the cellular network including between the SDN command and control center 161 and the cell broadcast center 166 provides efficient in-flight communication with UAVs 164 within a defined area 164. This provides ability for different or preferential treatment based on UAV category and current location.

Although not every conceivable combination of components and methodologies for the purposes describing the present disclosure have been set out above, the examples provided will be sufficient to enable one of ordinary skill in the art to recognize the many combinations and permutations possible in respect of the present disclosure. Accordingly, this disclosure is intended to embrace all such alterations, modifications and variations that fall within the spirit and scope of the appended claims. For example, numerous methodologies for defining in-flight communications may be encompassed within the concepts of the present disclosure.

In particular and in regard to the various functions performed by the above described components, devices, circuits, systems and the like, the terms (including a reference to a "means") used to describe such components are intended to correspond, unless otherwise indicated, to any component which performs the specified function of the described component (e.g., a functional equivalent), even though not structurally equivalent to the disclosed structure, which performs the function in the herein illustrated exemplary aspects of the embodiments. In this regard, it will also be recognized that the embodiments includes a system as well as a computer-readable medium having computer-executable instructions for performing the acts and/or events of the various methods.

In addition, while a particular feature may have been disclosed with respect to only one of several implementations, such feature may be combined with one or more other features of the other implementations as may be desired and advantageous for any given or particular application. Furthermore, to the extent that the terms "includes," and "including" and variants thereof are used in either the detailed description or the claims, these terms are intended to be inclusive in a manner similar to the term "comprising."

What is claimed:

1. A system for in-flight communications with a first unmanned aerial vehicle (UAV) comprising:

a software defined command and control center in communication with the first UAV;

wherein the first UAV is associated with a software defined user equipment (UE) category and is associated with a plurality of UAVs in an area and a message transmitted by the command and control center identifies the first UAV based on the UE category and instructs the plurality of UAVs in the area to alter routing of packets within a mesh network based on information comprising a weather condition, wherein the mesh network is a communication network among the plurality of UAVs.

2. The system of claim 1 wherein the command and control center is configured to receive an input from an external source and to generate the message as a function of the input.

3. The system of claim 2 wherein the input comprises an emergency.

4. The system of claim 3 wherein the message comprises an identification of the input and the first UAV is configured to change its flight plan based on the message.

5. The system of claim 2 further comprising a policy generator and wherein the command and control center is configured to receive policy updates from the policy generator and to create the message as a function of the policy updates.

6. The system of claim 1 wherein the command and control center is configured to receive policies and to change its configuration dynamically based on one of a policy generator, the type of UAV, or an external event.

7. The system of claim 1, wherein each of the plurality of UAVs is associated with a UE category; a cell broadcast center in communication with the command and control center and also in communication with the first UAV and wherein the cell broadcast center is configured to relay the message only to the plurality of UAVs having the UE category identified in the message.

8. The system of claim 1 wherein the UE category is at least one of government, transport and surveillance.

9. A system comprising:

a first unmanned airborne vehicle (UAV) associated with a software defined user equipment (UE) category; and a software defined command and control center in communication with the first UAV, the command and control center having a processor; and a memory coupled with the processor, the memory having stored thereon executable instructions that when executed by the processor cause the processor to effectuate operations comprising:

receiving an input from an external source, wherein the input comprises information associated with a weather condition affecting a plurality of UAVs in an area, wherein the first UAV is one of the plurality of UAVs in the area; and transmitting an in-flight message to the first UAV based on the input, wherein the message includes the UE category and instructions to alter routing of packets within a mesh network based on the input, wherein the mesh network is a communication network among the plurality of UAVs.

10. The system of claim 9 wherein the message causes the first UAV to alter its flight plan based on the message.

11. The system of claim 9 wherein each of the plurality of UAVs has a UE category associated therewith and a cell broadcast center in communication with the command and control center and wherein the message is transmitted from the command and control center to the plurality of UAVs through the cell broadcast center.

12. The system of claim 11 wherein only the UAVs having a UE category that matches the UE category in the message is configured to interpret the message.

13. The system of claim 9, wherein each of the plurality of the UAVs has a UE category associated therewith and wherein each of the plurality of the UAVs are configured to relay the message to other UAVs having the same UE category over the mesh network.

14. The system of claim 9, wherein each of the plurality of UAVs reacts to the message based on the UE category of each of the plurality of the UAVs.

15. The system of claim 9 wherein the UE categories comprise transport and surveillance.

16. A method comprising:

receiving at a software defined command and control center, an input from an external source, wherein the input comprises information associated with a weather condition affecting a plurality of UAVs in an area, wherein a first UAV is one of the plurality of UAVs in the area; and transmitting, by the command and control center, an in-flight message to the first UAV based on the input, wherein the message includes a user equipment (UE) category and instructions to alter routing of packets within a mesh network based on the input, wherein the mesh network is a communication network among the plurality of UAVs.

17. The method of claim 16 wherein the transmitting step causes the first UAV to act based on the UE category.

18. The method of claim 16 wherein the transmitting step includes a cell broadcast to the plurality of UAVs, each of the plurality of UAVs has a UE category associated therewith, and wherein the cell broadcast causes the each of the plurality of UAVs to act based on the UE category associated with the each of the plurality of UAVs.

19. The method of claim 18 wherein the message is further relayed from one of the plurality of UAVs to another UAV in a similar UE category.

20. The method of claim 16 wherein the UE categories comprise government and surveillance.

* * * * *